US010668646B2

(12) United States Patent
Kawamura et al.

(10) Patent No.: US 10,668,646 B2
(45) Date of Patent: Jun. 2, 2020

(54) MIXER INCLUDING FOAM FEEDING PORT, MIXING METHOD, AND METHOD FOR PRODUCING LIGHTWEIGHT GYPSUM BOARD

(71) Applicant: YOSHINO GYPSUM CO., LTD., Tokyo (JP)

(72) Inventors: Toshiaki Kawamura, Tokyo (JP); Kazuki Nanba, Matsue (JP)

(73) Assignee: YOSHINO GYPSUM CO., LTD., Tokyo (JP)

( * ) Notice: Subject to any disclaimer, the term of this patent is extended or adjusted under 35 U.S.C. 154(b) by 157 days.

(21) Appl. No.: 15/104,093

(22) PCT Filed: Nov. 17, 2014

(86) PCT No.: PCT/JP2014/080360
§ 371 (c)(1),
(2) Date: Sep. 29, 2016

(87) PCT Pub. No.: WO2015/093209
PCT Pub. Date: Jun. 25, 2015

(65) Prior Publication Data

US 2017/0008192 A1 Jan. 12, 2017

(30) Foreign Application Priority Data

Dec. 17, 2013 (JP) ..... 2013-259915

(51) Int. Cl.
*B28C 5/12* (2006.01)
*B01F 15/02* (2006.01)
(Continued)

(52) U.S. Cl.
CPC ..... *B28C 5/1269* (2013.01); *B01F 7/00766* (2013.01); *B01F 15/0292* (2013.01);
(Continued)

(58) Field of Classification Search
CPC .... B01F 15/0266; B01F 7/26; B01F 15/0233; B01F 15/0276; B01F 15/0292;
(Continued)

(56) References Cited

U.S. PATENT DOCUMENTS 6,193,408 B1 * 2/2001 Miura ..... B01F 7/00758 366/304
6,402,359 B2 * 6/2002 Bahner ..... B01F 3/04531 366/102
(Continued)

FOREIGN PATENT DOCUMENTS

DE 298 05 044 U1 7/1999
DE 20 2013 006 962 U1 10/2013
(Continued)

OTHER PUBLICATIONS

Extended European Search Report dated Jul. 18, 2017 from European Patent Application No. 14871683.0, 8 pages.
(Continued)

*Primary Examiner* — Charles Cooley
(74) *Attorney, Agent, or Firm* — Staas & Halsey LLP

(57) ABSTRACT

Behavior of a flow of foam ejected to a gypsum slurry can be stabilized, and a relatively large amount of foam can be homogeneously or uniformly dispersed in the slurry. A mixer has a mixing area for preparing gypsum slurry, a slurry delivery section for delivering the slurry from the mixing area, and a feeding port for feeding foam to the slurry in the mixing area and/or the slurry delivery section under pressure. The slurry having the foam mixed therein is supplied to a production line for forming gypsum boards or gypsum-based boards. The feeding port is provided with a partition member dividing an ejecting region. The ejecting region is divided into a plurality of openings, which simultaneously eject the foam to the slurry.

9 Claims, 13 Drawing Sheets

(51) Int. Cl.

| | |
|---|---|
| ***B28C 5/08*** | (2006.01) |
| ***B28C 5/06*** | (2006.01) |
| ***B28B 17/02*** | (2006.01) |
| ***B01F 7/00*** | (2006.01) |
| ***B28B 1/50*** | (2006.01) |
| ***B28C 5/00*** | (2006.01) |

(52) U.S. Cl.
CPC ..... *B01F 15/0293* (2013.01); *B28B 1/50* (2013.01); *B28B 17/023* (2013.01); *B28C 5/006* (2013.01); *B28C 5/06* (2013.01); *B28C 5/0881* (2013.01); *B28C 5/1246* (2013.01); *B28C 5/1253* (2013.01)

(58) Field of Classification Search
CPC .... B01F 15/0293; B01F 7/00766; B01F 3/12; C04B 11/00; B28C 5/0881; B28C 5/1253; B28C 5/16; B28C 5/1269; B28C 5/006; B28C 5/06; B28B 1/50; B28B 17/023
USPC ..... 366/64, 96–99, 162.1, 6, 8, 18, 20, 35, 366/38, 51, 65, 102, 141, 168.1, 171.1, 366/172.1, 172.2, 181.7, 303–304, 366/315–317, 167.1–175.3, 183.2; 156/39, 44
See application file for complete search history.

(56) References Cited

U.S. PATENT DOCUMENTS

| | | | | |
|---|---|---|---|---|
| 6,494,609 | B1 | 12/2002 | Wittbold et al. | |
| 6,742,922 | B2 | 6/2004 | Shrader et al. | |
| 7,690,834 | B2 * | 4/2010 | Nakamura | B01F 7/00766 156/39 |
| 8,685,188 | B2 * | 4/2014 | Yamaji | B28B 19/0015 156/346 |
| 9,856,168 | B2 * | 1/2018 | Ueno | C04B 11/00 |
| 10,011,045 | B2 * | 7/2018 | Wittbold | B01F 7/18 |
| 2001/0015935 | A1 * | 8/2001 | Bahner | B01F 3/04531 366/65 |
| 2004/0101695 | A1 * | 5/2004 | Abe | A61L 9/01 428/454 |
| 2005/0248049 | A1 * | 11/2005 | Gannaway | B01F 3/04446 264/51 |
| 2006/0045975 | A1 | 3/2006 | Yamaji et al. | |
| 2007/0008815 | A1 * | 1/2007 | Nakamura | B01F 7/00766 366/172.1 |
| 2015/0315074 | A1 * | 11/2015 | Ueno | B28C 5/16 106/680 |
| 2015/0354432 | A1 | 12/2015 | Gehrlein et al. | |
| 2017/0008192 | A1 * | 1/2017 | Kawamura | B01F 7/00766 |
| 2018/0333691 | A1 * | 11/2018 | Scaff | B01F 7/00841 |
| 2019/0054656 | A1 * | 2/2019 | Hirooka | B01F 3/04446 |

FOREIGN PATENT DOCUMENTS

| | | | | |
|---|---|---|---|---|
| EP | 0613764 | A1 | 9/1994 | |
| EP | 0 972 621 | A2 | 1/2000 | |
| EP | 0 972 621 | A3 | 1/2000 | |
| EP | 1 254 699 | A1 | 11/2002 | |
| EP | 3342571 | A4 * | 12/2018 | B28B 17/023 |
| JP | 7-1437 | | 1/1995 | |
| JP | 8-25342 | | 1/1996 | |
| JP | 2000-6137 | | 1/2000 | |
| JP | 2001-300933 | | 10/2001 | |
| WO | WO-9967074 | A1 * | 12/1999 | B28B 13/02 |
| WO | 00/56435 | | 9/2000 | |
| WO | 2004/026550 | A1 | 4/2004 | |
| WO | 2004/103663 | A1 | 12/2004 | |

OTHER PUBLICATIONS

International Search Report dated Feb. 3, 2015 in International Application No. PCT/JP2014/080360.
International Preliminary Report on Patentability dated Jun. 21, 2016 in related International Application No. PCT/JP2014/080360.

* cited by examiner

[Fig.1]
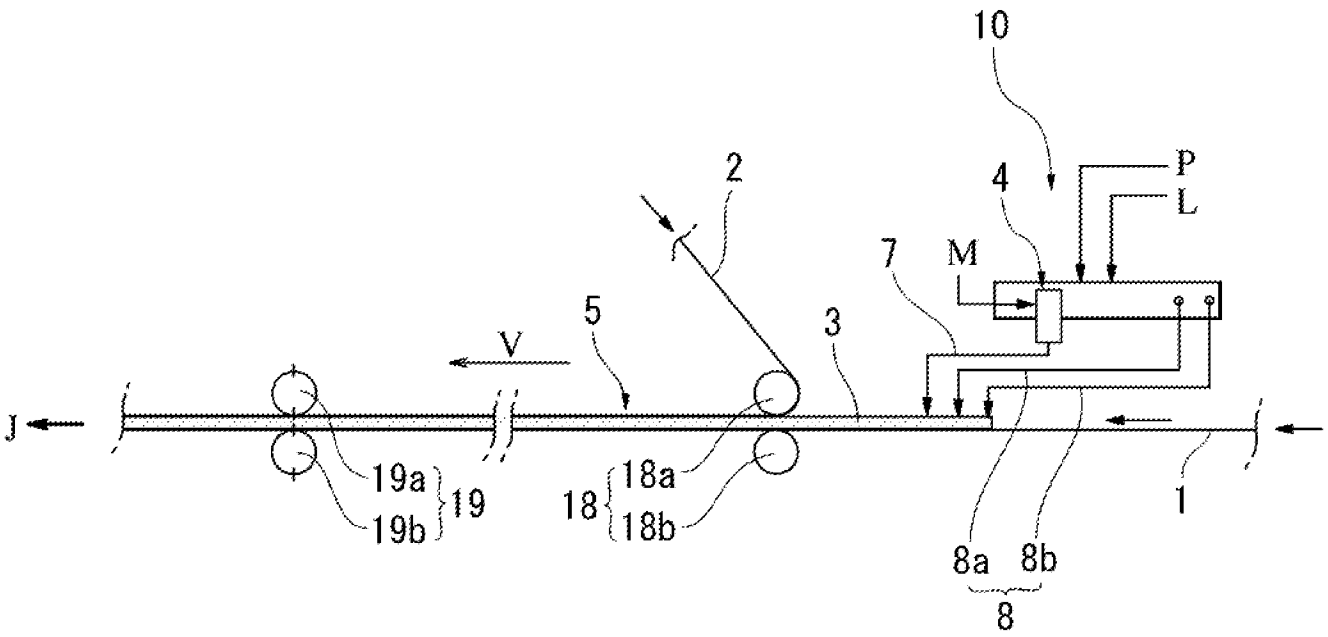

[Fig.2]
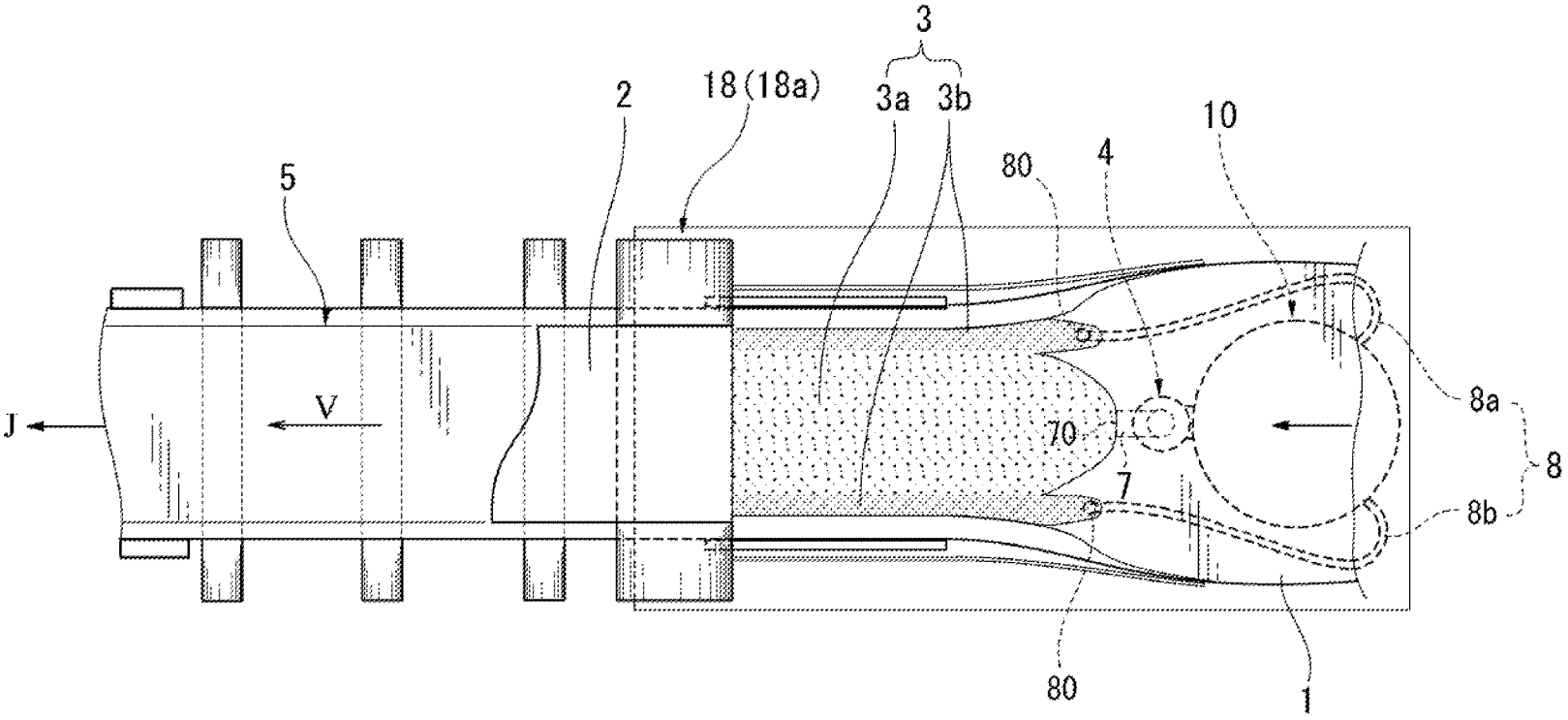

[Fig.3]
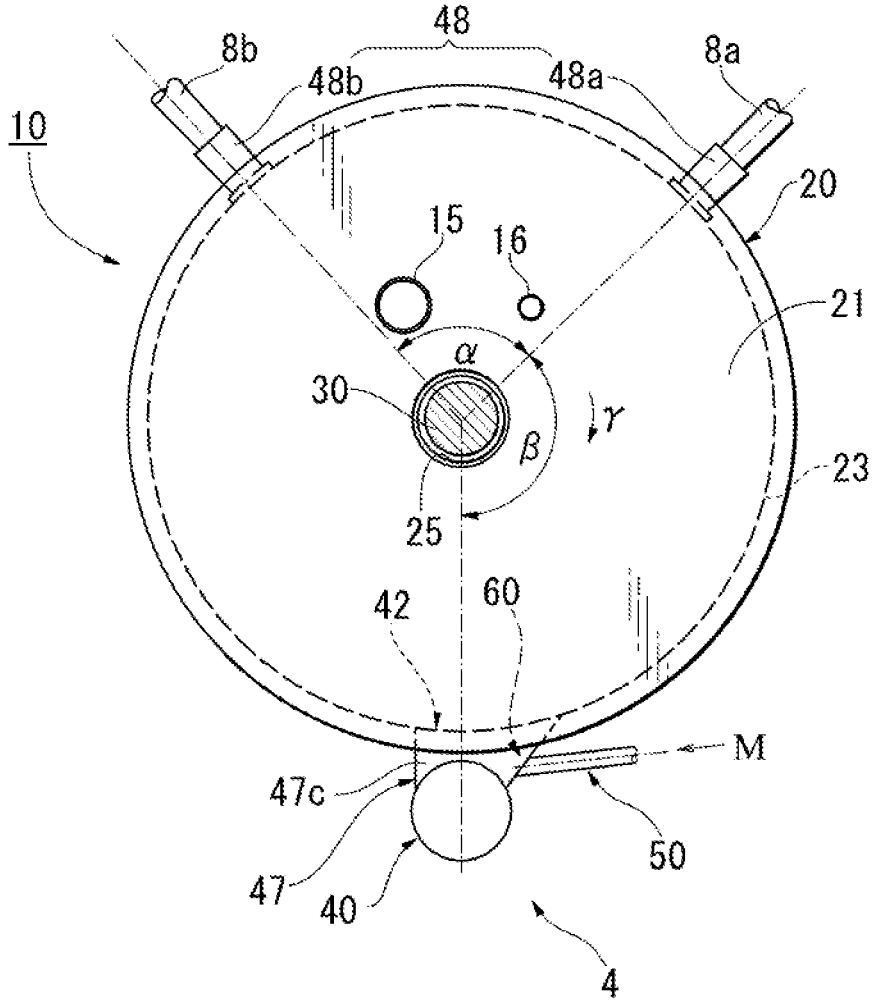

[Fig.4]
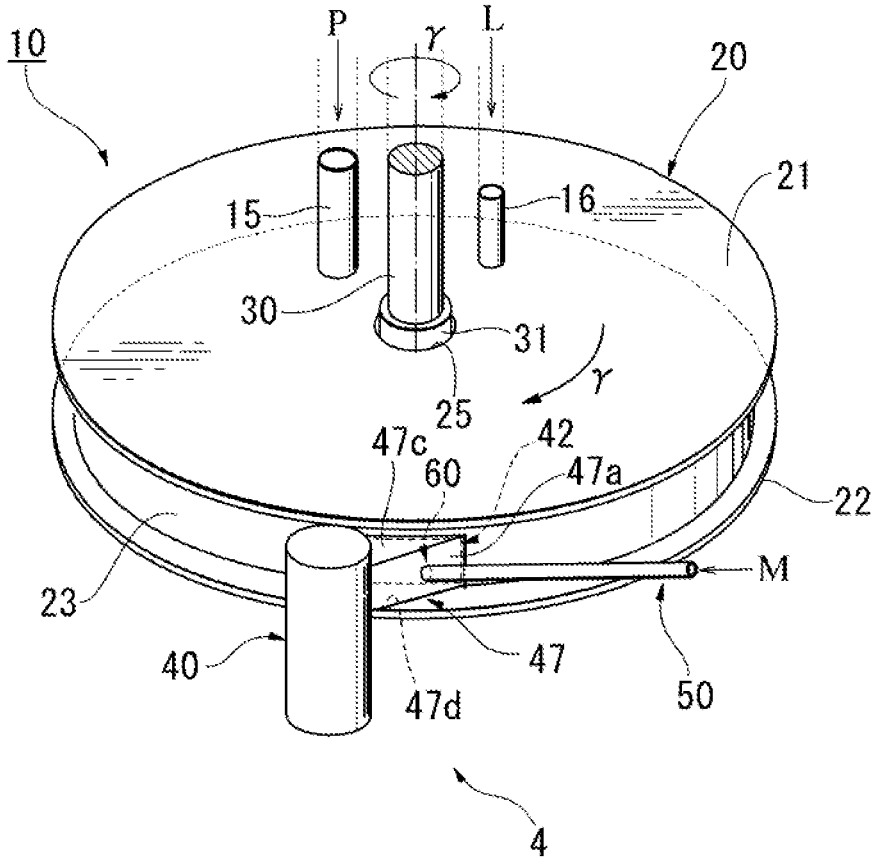

[Fig.5]
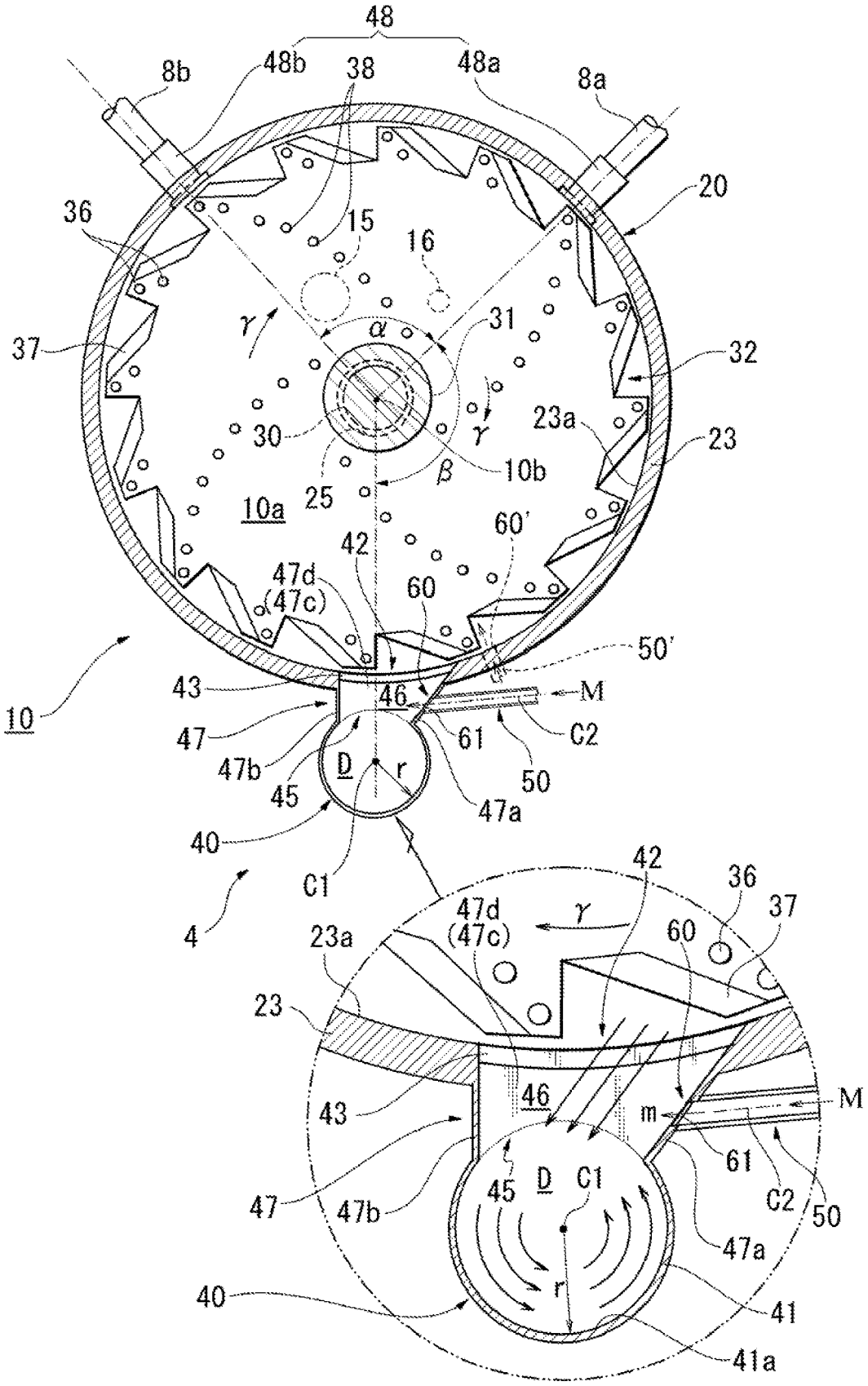

[Fig.6]
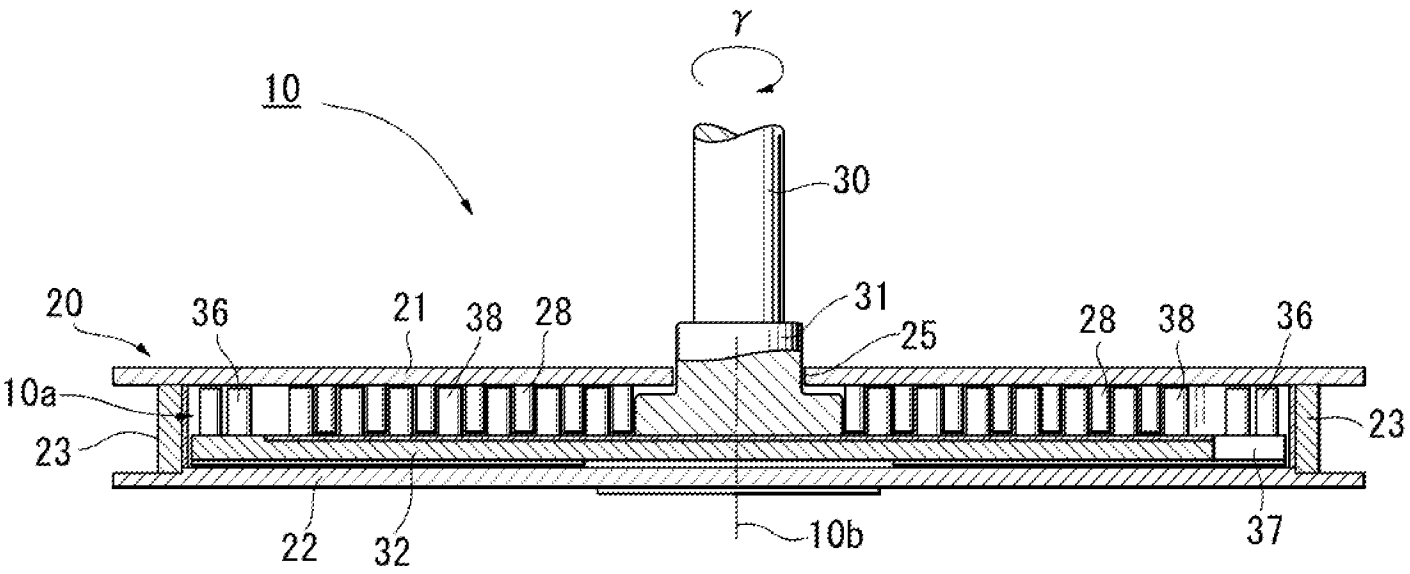

[Fig.7]
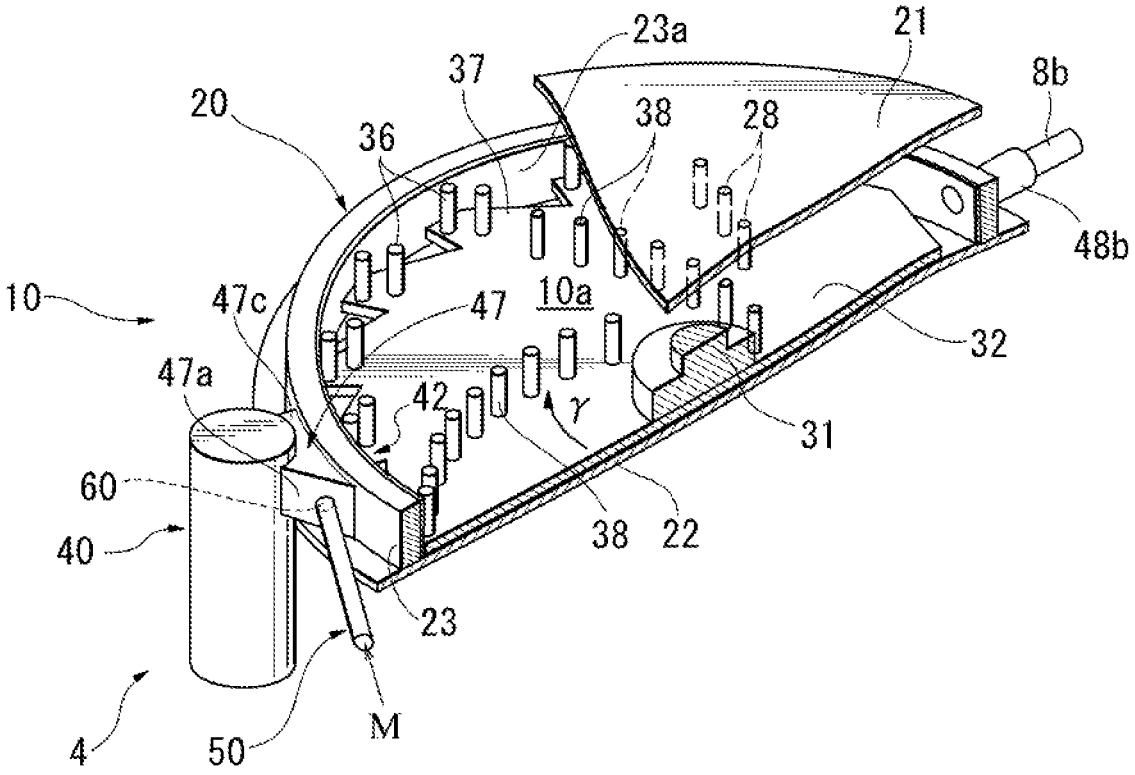
[Fig.8]
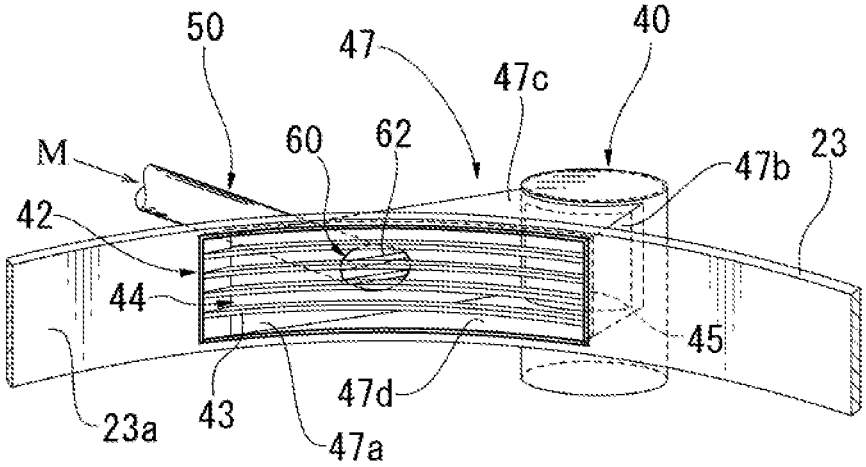

【FIG. 9】
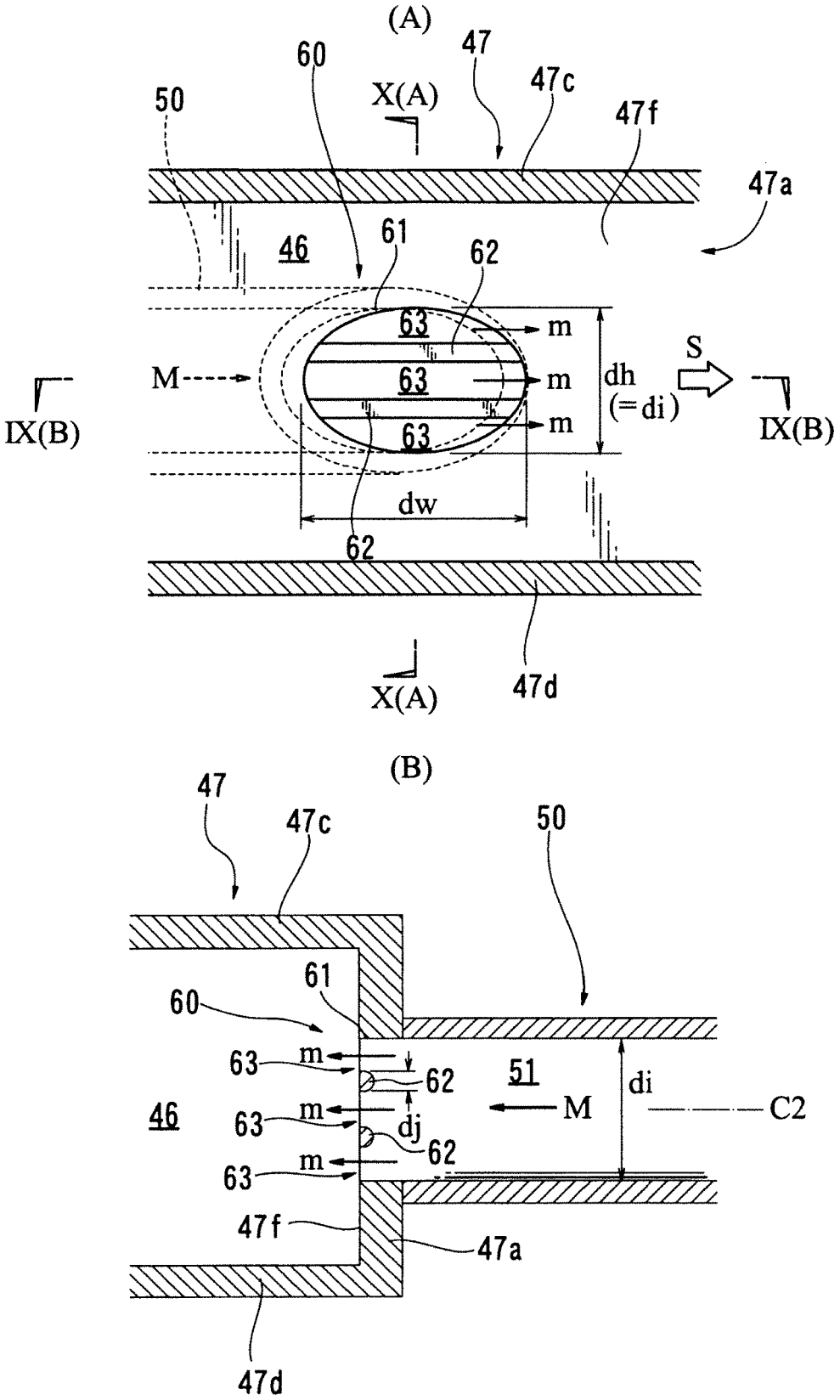

[Fig.10]
(A)
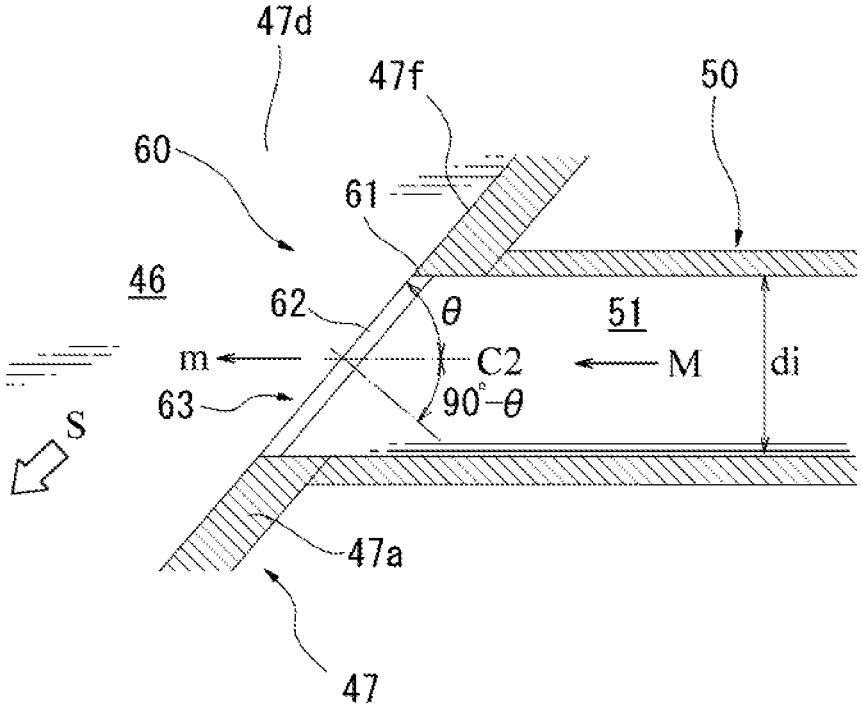
(B)
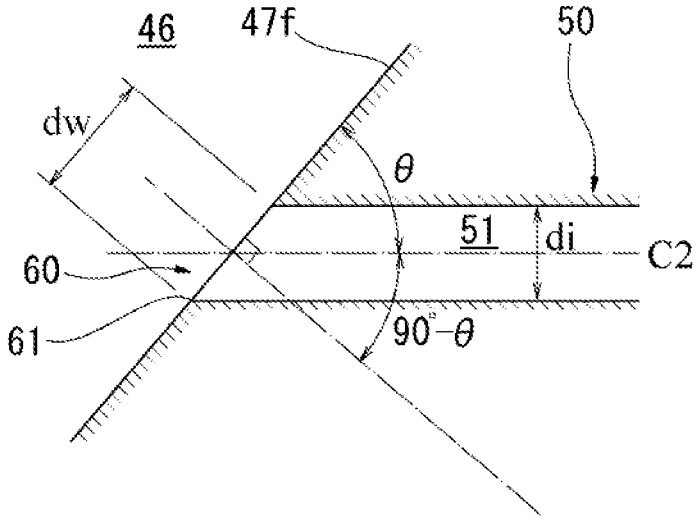

[Fig.11]
(A)
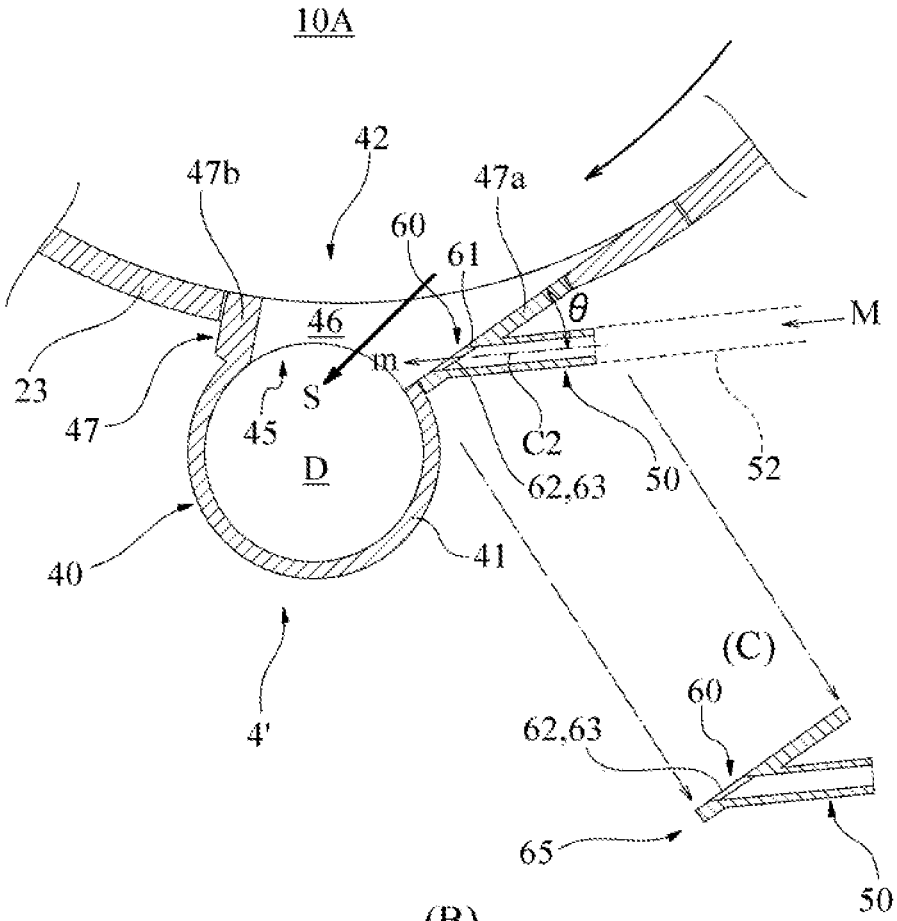
(B)
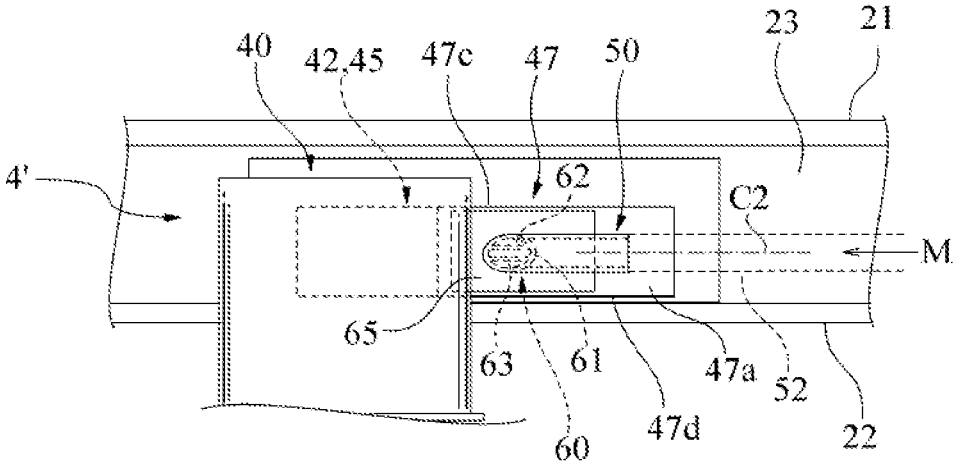

[Fig.12]
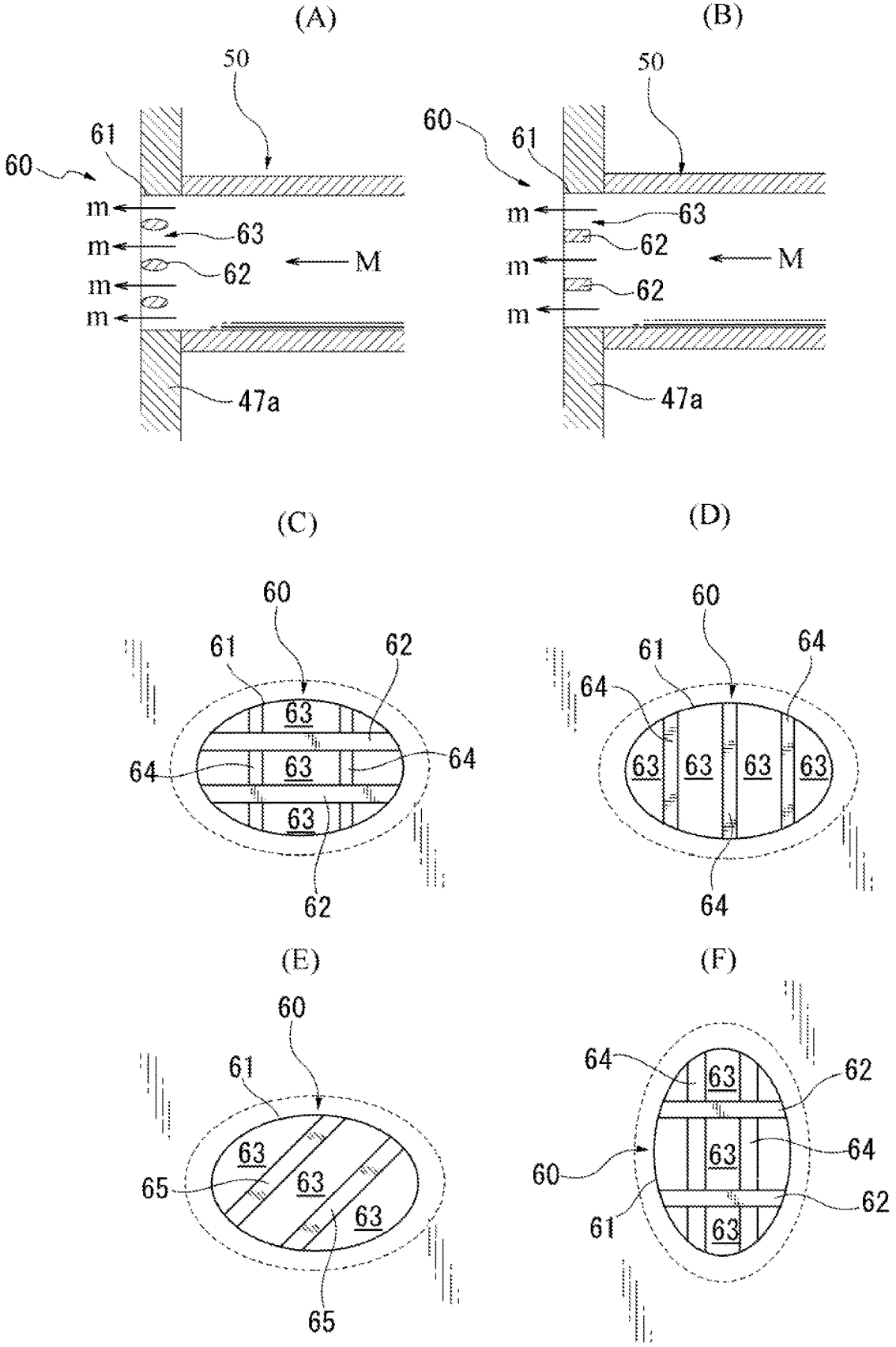

[Fig.13]
(A)
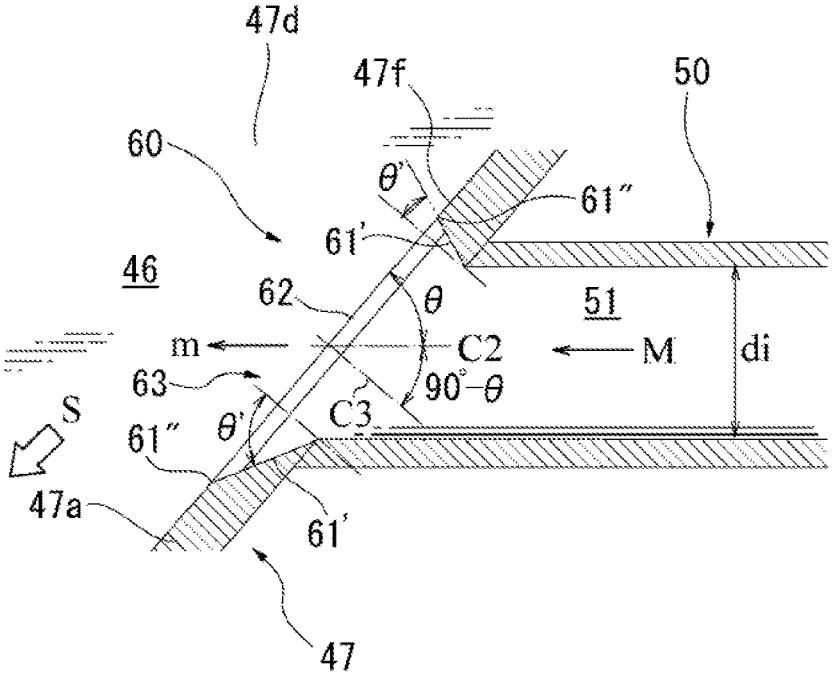
(B)
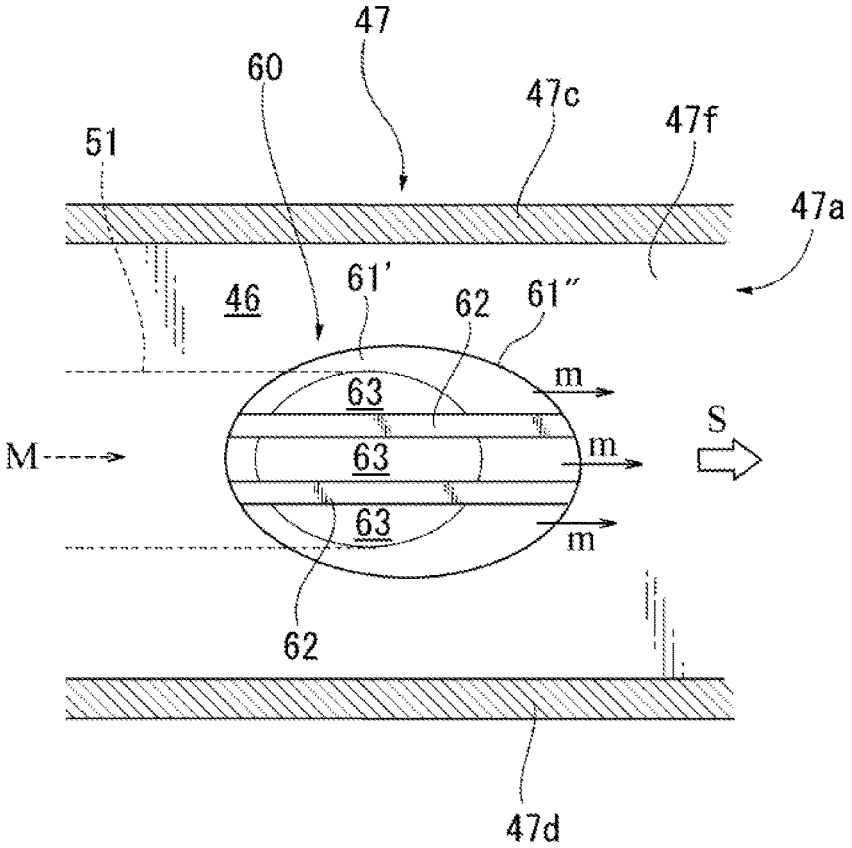

[Fig.14]
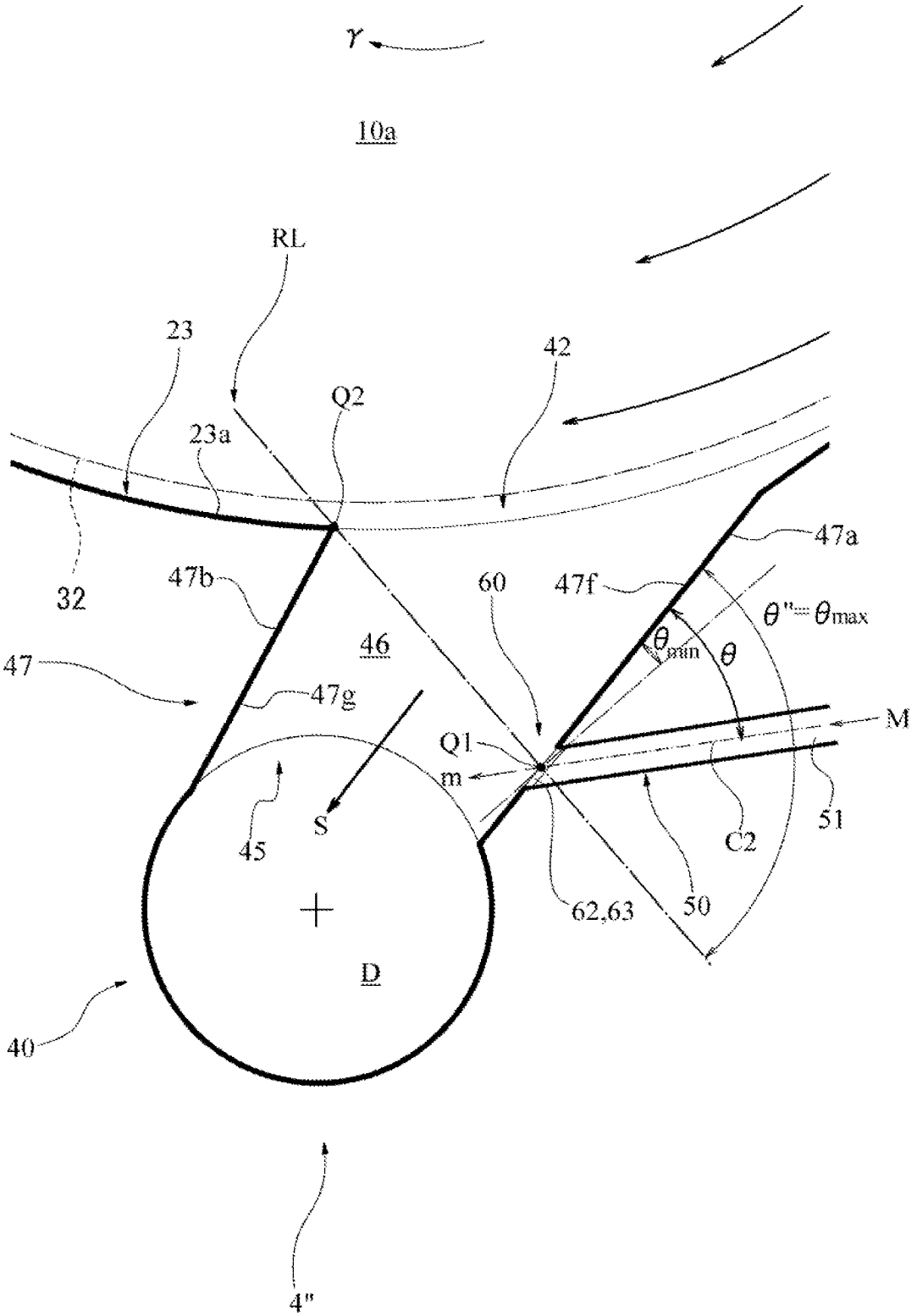

MIXER INCLUDING FOAM FEEDING PORT, MIXING METHOD, AND METHOD FOR PRODUCING LIGHTWEIGHT GYPSUM BOARD

CROSS-REFERENCE TO RELATED APPLICATIONS

This application is a U.S. National Phase application of PCT/JP2014/080360 filed Nov. 17, 2014, which claims the priority benefit of Japanese Patent Application No. 2013-259915, filed on Dec. 17, 2013, in the Japanese Patent Office, the contents of each of which are incorporated herein by reference.

TECHNICAL FIELD

The present invention relates to a mixer, mixing method and method for producing light-weight gypsum boards, and more specifically, such mixer and methods which have or use a feeding port of foam adapted to homogeneously or uniformly disperse a relatively large amount of foam in a gypsum slurry.

BACKGROUND ART

A gypsum board is known as a board having a gypsum core covered with sheets of paper for gypsum board liner. The gypsum boards are widely used in various kinds of buildings as architectural interior finish materials, because of their advantageous fire-resisting or fire-protecting ability, sound insulation performance, workability, cost performance and so on. In general, the gypsum boards are produced by a continuous slurry pouring and casting process. This process comprises a mixing step of admixing calcined gypsum, adhesive auxiliary agent, set accelerator, water-reducing agent, foam (or foaming agent) and so forth with mixing water in a mixer; a forming step of pouring calcined gypsum slurry prepared by the mixer (referred to as "slurry" hereinafter) into an area between upper and lower sheets of paper for gypsum board liner and forming them in a continuous belt-like formation; and a drying and cutting step of roughly severing the solidified continuous belt-like layered formation, drying it forcibly and thereafter, cutting it to be a product size.

Usually, a thin type of circular centrifugal mixer is used as the mixer for preparing the slurry. This type of mixer comprises a flattened circular casing and a rotary disc rotatably positioned in the casing. A plurality of material feeding ports for feeding the above materials into the mixer are disposed in a center zone of a top cover or an upper plate of the casing, and a slurry outlet port for delivering mixture (slurry) from the mixer is provided in a periphery of the casing or a lower plate (bottom cover) thereof. Typically, a rotary shaft is connected to the disc for rotating the disc, and the shaft is connected with rotary drive means. The upper plate of the casing is equipped with a plurality of upper pins (stationary pins) depending therefrom down to the vicinity of the disc. The disc is equipped with lower pins (movable pins) which are vertically fixed on the disc and which extend up to the vicinity of the upper plate. The upper and lower pins are arranged in radially alternate positions. The ingredients to be mixed are supplied on the disc through the respective feeding ports, and are stirred and mixed while being moved radially outward on the disc under an action of centrifugal force, and then, delivered out of the mixer through the slurry outlet port, which is positioned on the periphery of the casing or the lower plate (bottom cover). The mixer with this arrangement is called a pin type of mixer, which is disclosed in, e.g., International Publication of PCT Application No. WO00/56435 (Patent Literature 1).

As regards a method for delivering the slurry prepared in the mixer to the outside of the mixer, the following three kinds of methods are mainly known in the art:

(1) A vertical chute, which is also called as "canister", is attached to a slurry outlet port provided on an annular wall of the casing, and the slurry on the rotary disc is delivered into the chute under the action of centrifugal force, so that the slurry flowing into the chute is gravitationally spouted onto the sheet of paper for gypsum board liner (International Publication of PCT Application No. WO2004/026550 (Patent Literature 2));

(2) A tubular passage for transporting the slurry is transversely connected to the slurry outlet port provided on the annular wall of the casing, so that the slurry is spouted onto the sheet of paper with use of a delivery pressure of the mixer (U.S. Pat. No. 6,494,609 (Patent Literature 3));

(3) A slurry delivery tubular passage is vertically connected to the slurry outlet port provided on the lower plate of the casing, so that the slurry of the mixer is gravitationally spouted onto the sheet of paper through the delivery passage (Japanese Patent Laid-Open Publication No. 2001-300933 (Patent Literature 4)).

In general, foam or foaming agent is fed to the slurry in the mixer, in order to regulate or adjust the specific gravity of gypsum board. Proper mixing of the foam or foaming agent in the slurry is considered to be an essential matter for reduction of weight of gypsum boards. Therefore, in the method for producing gypsum boards in recent years, a technique for properly mixing an appropriate quantity of foam or foaming agent with the slurry is considered to be especially important. As regards reduction in a supply amount of foam or foaming agent and uniform mixing of the slurry and the foam, it is considered that a relation is very important between a method for feeding the foam or foaming agent to the slurry and a method for delivering the slurry (Patent Literatures 2 and 3).

For instance, each of U.S. Pat. No. 6,742,922 (Patent Literature 5) and International Publication of PCT Application No. WO2004/103663 (Patent Literature 6) discloses a technique intended to attain homogeneous dispersion and distribution of the foam or foaming agent in the slurry by means of a slurry swirling flow in a vertical chute.

CITATION LIST

Patent Literatures

[Patent Literature 1] International Publication of PCT Application No. WO00/56435

[Patent Literature 2] International Publication of PCT Application No. WO2004/026550

[Patent Literature 3] U.S. Pat. No. 6,494,609

[Patent Literature 4] Japanese Patent Laid-Open Publication No. 2001-300933

[Patent Literature 5] U.S. Pat. No. 6,742,922

[Patent Literature 6] International Publication of PCT Application No. WO2004/103663

SUMMARY OF INVENTION

Technical Problem

In a process for producing gypsum boards in recent years, an amount of mixing water tends to be reduced for improvement of a thermal efficiency (reduction of a thermal load) in a drying step. In relation with reduction in the amount of mixing water, an amount of foam or foaming agent to be mixed in the slurry tends to be relatively increased.

Further, a specific gravity of the gypsum slurry mainly depends on the amount of foam mixed therein. In a case where a process for producing light-weight gypsum boards having cores with a specific gravity approximately in a range from 0.4 to 0.7, a relatively large amount of foam or foaming agent is mixed in the slurry.

In general, a foam feeding port of a foam feeding conduit, which feeds the gypsum slurry with the foam, opens on an annular wall of the mixer, a wall surface of a hollow connector part connecting the annular wall and a chute, a wall surface of the chute, and so forth. The present inventors have found out in their experiments that irregular or discontinuous behavior, or pulsation phenomenon is apt to occur in the flow of foam effluent from the foam feeding port, in a case where a large amount of foam is fed to the slurry through the foam feeding port to the gypsum slurry for improvement of thermal efficiency, reduction in weight of gypsum boards and the like, as set forth above.

When such irregular or discontinuous behavior, or pulsation phenomenon occurs in the supply flow of foam, the foam is not uniformly dispersed in the slurry. As the results, problems of local blisters or defects of the surface of the gypsum boards, or the like, are apt to occur, owing to local aggregation of the foam, uneven distribution of the foam and so forth.

It is an object of the present invention to provide a mixer, a mixing method and a method for producing light-weight gypsum boards, which can stabilize the behavior of flow of the foam ejected to the gypsum slurry, thereby allowing a relatively large amount of foam to homogeneously or uniformly disperse in the slurry.

Solution to Problem

The present invention provides a mixer, which has a mixing area for preparing gypsum slurry, a slurry delivery section for delivering the slurry from the mixing area, and a feeding port of foam for feeding the slurry in the mixing area and/or the slurry in the slurry delivery section with the foam under pressure, and which is arranged to supply the slurry with the foam mixed therein, to a production line for forming gypsum boards or gypsum-based boards, wherein said feeding port has a partition member for dividing an ejecting region of the port, and the partition member divides the ejecting region into a plurality of openings which simultaneously eject the foam to said slurry.

The present invention also provides a mixing method of gypsum slurry, in which the gypsum slurry is prepared in a mixing area of a mixer, the slurry is delivered out of the mixing area through a slurry delivery section of the mixer, foam is fed under pressure to the slurry in the mixing area and/or the slurry in the slurry delivery section, and a production line for forming gypsum boards or gypsum-based boards, is supplied with the slurry having the foam mixed therein, comprising steps of:

positioning a feeding port of the foam for feeding the foam to said slurry, in the mixing area and/or the slurry delivery section, dividing an ejecting region of said port ejecting the foam to a flowing fluid of said slurry, by a partition member, and ejecting said foam to said fluid of the slurry simultaneously through a plurality of openings defined by division of the ejecting region.

From another aspect of the present invention, this invention provides a method for producing light-weight gypsum boards having a specific gravity equal to or less than 0.8, in which gypsum slurry is prepared in a mixing area of a mixer, the slurry is delivered out of the mixing area through a slurry delivery section of the mixer, foam is fed under pressure to the slurry in the mixing area and/or the slurry in the slurry delivery section, and a production line for forming gypsum boards is supplied with the slurry having the foam mixed therein, comprising steps of:

positioning a feeding port of the foam for feeding the foam to said slurry, in the mixing area and/or the slurry delivery section, dividing an ejecting region of said port ejecting the foam to a flowing fluid of said slurry, by a partition member, and ejecting said foam to said fluid of the slurry simultaneously through a plurality of openings defined by division of the ejecting region, wherein an amount of the foam to be ejected to said slurry is so set as to form a gypsum core of said gypsum board having a specific gravity equal to or less than 0.7.

According to the present invention, the ejecting region of the feeding port discharging the foam to the slurry is divided into the plurality of openings by the partition member. The partition member gives the fluid resistance to the foam fed to the feeding port under pressure, and divides the supply flow of the foam into a plurality of streams. Even if the amount of form is relatively greatly increased for producing the gypsum core of the gypsum board with a specific gravity equal to or less than 0.7, irregular or discontinuous behavior, pulsation phenomenon and so forth are difficult to occur in the supply flow of foam. Therefore, the behavior of the ejecting flow of the foam become stable so that the foam can disperse in the slurry homogeneously or uniformly.

Advantageous Effects of Invention

According to the present invention, a mixer, a mixing method and a method for producing light-weight gypsum boards can be provided, which can stabilize the behavior of the flow of the foam ejected to the gypsum slurry, thereby allowing a relatively large amount of foam to homogeneously or uniformly disperse in the slurry.

BRIEF DESCRIPTION OF THE DRAWINGS

FIG. 1 is an explanatory process diagram partially and schematically illustrating a forming process of gypsum boards.

FIG. 2 is a partial plan view schematically illustrating an arrangement of a gypsum board manufacturing apparatus.

FIG. 3 is a plan view illustrating a whole arrangement of a mixer as shown in FIGS. 1 and 2.

FIG. 4 is a perspective view illustrating the whole arrangement of the mixer.

FIG. 5 is a transverse cross-sectional view including a partially enlarged cross-sectional view, which shows an internal structure of the mixer.

FIG. 6 is a vertical cross-sectional view showing the internal structure of the mixer.

FIG. 7 is a fragmentary sectional perspective view showing the internal structure of the mixer.

FIG. 8 is a perspective view showing a structure of a slurry delivery section.

FIG. 9(A) is an elevational view showing a configuration of a foam feeding port, and FIG. 9(B) is a cross-sectional view taken along a line IX(B)-IX(B) of FIG. 9(A).

FIG. 10(A) is a cross-sectional view taken along a line X(A)-X(A) of FIG. 9(A), and FIG. 10(B) is a transverse cross-sectional view schematically showing a positional relationship among a foam feeding conduit, the foam feeding port and a vertical side wall.

FIGS. 11(A)-11(C) are cross-sectional or side elevational views showing a modification of the slurry delivery section.

FIGS. 12(A) and 12(B) are cross-sectional views and FIGS. 12(C)-12(F) are elevational views, which show modifications of the foam feeding port.

FIGS. 13(A) and 13(B) are cross-sectional or elevational view which show the other modification of the foam feeding port.

FIG. 14 is a cross-sectional view schematically illustrating a method for setting an inclination angle of the foam feeding conduit.

DESCRIPTION OF EMBODIMENTS

In a preferred embodiment of the present invention, a fluid passage of the foam for delivering the foam to the aforementioned feeding port has its center axis or its center line of the flow-path inclined at a predetermined angle with respect to an ejecting face of the feeding port. Therefore, the ejecting face is enlarged in comparison with a cross-section of the fluid passage (the cross-section perpendicular to the direction of flow). For example, a fluid passage with a cross-section in a form of a perfect circle has the center axis or the center line of the flow-path horizontally or transversely inclined with respect to the ejecting face, and a flow-path wall of the fluid passage joins a peripheral edge of the ejecting face. The ejecting face horizontally or transversely enlarges in accordance with the inclination angle of the fluid passage, and the peripheral edge of the ejecting face has an elliptical form with its long axis being directed horizontally or transversely.

Preferably, the angle θ between the ejecting face and the center axis or the center line of the flow-path is set to be in a range of 90°±80°, more preferably, in a range of $10° \leq \theta \leq 120°$.

Alternatively, the feeding port may be formed with an opening edge diverging radially outward and toward the slurry passage, so that an inner circumferential surface of the edge is inclined in a flared form or in a divergent shape, whereby the ejecting face of the feeding port is enlarged.

Preferably, the ejecting region is provided with the plurality of partition members extending along the flowing direction of the slurry, and a plurality of slit-shaped fluid passages, each extending in the flowing direction of the slurry, are formed as the aforementioned openings in the ejecting region. A ratio between a cross-sectional area A1 of the ejecting face (the area surrounded by the peripheral edge of the ejecting face) and a total value A2 of areas of the openings is set to be in a range between A1:A2=1:0.5 and A1:A2=1:0.95, preferably, in a range between A1:A2=1:0.6 and A1:A2=1:0.85. A ratio between the area A1 and a cross-sectional area A3 of the fluid passage of the foam (the cross-section perpendicular to the flowing direction of the fluid) is set to be in a range between A3:A1=1:1.1 and A3:A1=1:6.0, preferably, in a range between A3:A1=1:1.1 and A3:A1=1:3.0.

In a preferred embodiment of the present invention, the feeding port is positioned in a hollow connector part for introducing the slurry effluent from the mixing area into a chute, so that the foam is fed to the slurry immediately after the slurry flows into the slurry passage of the hollow connector part from a slurry outlet port of the mixing area. Alternatively, the feeding port is arranged to open in the mixing area in the vicinity of the slurry outlet port, in order to feed the foam to the slurry immediately before the slurry flows out of the mixing area through the slurry outlet port.

In a preferred embodiment of the present invention, the apparatus for producing the gypsum boards is so arranged that the foam produced by foam producing means is delivered through a foam feeding conduit under pressure, and that the foam is ejected to the slurry and mixed therein under the feeding pressure of the foam.

Embodiment

With reference to the attached drawings, preferred embodiments of the present invention are described hereinafter.

FIG. 1 is an explanatory process diagram partially and schematically illustrating a forming process of gypsum boards, and FIG. 2 is a partial plan view schematically illustrating an arrangement of a gypsum board manufacturing apparatus.

A lower sheet of paper 1, which is a sheet of paper for a gypsum board liner, is continuously conveyed by a conveying device (not shown). A mixer 10 is located in a predetermined position in relation to a conveyance face of the conveying device, e.g., in a position above the conveyance face. Powder materials P, which includes calcined gypsum, adhesive agent, set accelerator, water reducing agent, additives, admixture and so forth, and liquid (water) L are fed to the mixer 10. The mixer 10 mixes these materials and discharges slurry (calcined gypsum slurry) 3 onto the sheet 1 by means of a slurry delivery section 4, a slurry discharge pipe 7 and conduits for fractionation 8 (8*a*, 8*b*). The conveying device and the lower sheet 1 constitutes a production line for forming the gypsum boards.

The slurry delivery section 4 is located so as to receive the slurry effluent from a periphery of the mixer 10 and introduce the slurry into the pipe 7. Foam M produced by foam production means (not shown), such as a foaming device, a bubbling device or the like, is fed to the section 4. The pipe 7 is so positioned as to pour the slurry of the section 4 onto a widthwise center area of the sheet 1 (a core area) through a slurry discharge port 70. The conduits 8*a*, 8*b* are so arranged as to pour onto widthwise end portions (edge zones) of the sheet 1, the slurry 3 effluent from the periphery of the mixer 10.

The sheet 1 is conveyed together with the slurry 3 to reach a pair of forming rollers 18 (18*a*, 18*b*). An upper sheet of paper 2 travels partially around a periphery of the upper roller 18*a* to convert its direction toward a conveyance direction. The diverted sheet 2 is brought into contact with the slurry 3 on the lower sheet 1 and transferred in the conveyance direction and substantially in parallel with the lower sheet 1. A continuous three-layered belt-like formation 5 comprising the sheets 1,2 and the slurry 3 is formed on a downstream side of the rollers 18. This formation 5 runs continuously at a conveyance velocity V while a setting reaction of the slurry 3 proceeds, and it reaches roughly cutting rollers 19 (19*a*, 19*b*). If desired, a variety of forming means may be employed instead of the forming rollers 18, such as the forming means using a passing-through action of an extruder, a gate with a rectangular opening, and so forth.

The cutting rollers 19 sever the continuous formation into boards of a predetermined length, so as to make boards having a gypsum core covered with the sheets of paper, i.e., green boards. Then, the green boards are conveyed through a dryer (not shown) which is located in a direction shown by an arrow J (on a downstream side in the conveyance direction), whereby the green boards are subjected to forced drying in the dryer. Thereafter, they are cut to be boards, each having a predetermined product length, and thus, gypsum board products are successively produced.

FIGS. 3 and 4 are plan and perspective views illustrating the whole arrangement of the mixer 10, and FIGS. 5, 6 and 7 are a transverse cross-sectional view including a partially enlarged cross-sectional view; a vertical cross-sectional view; and a fragmentary sectional perspective view, which show an internal structure of the mixer 10.

As shown in FIGS. 3 and 4, the mixer 10 has a flattened cylindrical housing or casing 20 (referred to as "casing 20" hereinafter). The casing 20 has a horizontal disk-like upper plate or top cover 21 (referred to as "upper plate 21" hereinafter), a horizontal disk-like lower plate or bottom cover 22 (referred to as "lower plate 22" hereinafter), and an annular wall or outer peripheral wall 23 (referred to as "annular wall 23" hereinafter) which is positioned in peripheral portions of the upper and lower plates 21, 22. The plates 21, 22 are positioned, vertically spaced apart at a predetermined distance, so that an internal mixing area 10*a* for mixing the powder materials P and liquid (water) L is formed in the mixer 10. A circular opening 25 is formed at a center part of the upper plate 21. An enlarged lower end portion 31 of a rotatable vertical shaft 30 extends through the opening 25. The shaft 30 is connected with rotary drive means, such as an electric drive motor (not shown), and driven in rotation in a predetermined rotational direction (clockwise direction γ as seen from its upper side, in this embodiment). If desired, a variable speed device, such as a variable speed gear mechanism or belt assembly, may be interposed between the shaft 30 and an output shaft of the rotary drive means.

A powder supply conduit 15 for feeding the area 10*a* with the powder materials P to be mixed is connected to the upper plate 21. A water supply conduit 16 for supplying a quantity of mixing water L to the area 10*a* is also connected to the upper plate 21. If desired, an internal pressure regulator (not shown) for limiting excessive increase of the internal pressure and so forth may be further connected to the upper plate 21.

On an opposite side of the section 4, fractionation ports 48 (48*a*, 48*b*) are provided on the annular wall 23. The conduits 8*a*, 8*b* are connected to the ports 48*a*, 48*b*, respectively. The ports 48*a*, 48*b* are positioned, spaced at a predetermined angle α from each other. Feeding ports of the conduits 15, 16 open within a range of the angle α in a center region of the upper plate 21, respectively.

As shown in FIG. 5, a slurry outlet port 42 of the slurry delivery section 4 is positioned on the annular wall 23, spaced at a predetermined angle from the fractionation port 48*a* in the rotational direction γ (on the downstream side). The port 42 opens on an internal circumferential surface of the wall 23. A foam feeding conduit 50, which feeds the foam M to the slurry for adjusting the specific gravity of the slurry, is connected to a hollow connector part 47 of the section 4. An upstream end (not shown) of the conduit 50 is connected with the foam production device (not shown), such as a foaming device, a bubbling device or the like. A foam feeding port 60 provided at a downstream end of the conduit 50 opens on an inner wall surface of the part 47. The port 60 is positioned in proximity to the port 42, on a downstream side of the port 42. If necessary, foam feeding ports (not shown) may be additionally provided on the ports 48 (48*a*, 48*b*) to feed the fractionated slurry with the foam M for adjusting the specific gravity of the slurry.

As shown in FIGS. 5 to 7, a rotary disc 32 is rotatably positioned in the casing 20. A lower face of the end portion 31 of the shaft 30 is fixedly secured to a center part of the disc 32. The center axis 10*b* of the disc 32 coincides with an axis of rotation of the shaft 30. The disc 32 is rotated with rotation of the shaft 30 in a direction as indicated by the arrow γ (clockwise direction).

A number of lower pins (movable pins) 38 are arranged on the rotary disc 32 in a plurality of rows extending generally in its radial direction. The lower pins 38 are vertically fixed on the upper surface of the disc 32 in its inward zone. The disc 32 is formed with a number of tooth configurations 37 in its peripheral zone, in this embodiment. The tooth configurations 37 act to displace or energize the mixed fluid (slurry) in an outward and rotational direction. A plurality of pins 36 are vertically fixed on each of the tooth configurations 37.

As shown in FIGS. 6 and 7, a number of upper pins (stationary pins) 28 are fixed to the upper plate 21 to depend therefrom in the internal mixing area 10*a*. The upper pins 28 and the lower pins 38 are alternately arranged in the radial direction of the disc 32 so that the pins 28, 38 make relative motions for mixing and stirring the materials of gypsum board in the casing 20 when the disc rotates.

When gypsum boards are produced, the rotary drive means of the mixer 10 is operated to rotate the rotary disc 32 in the direction of arrow γ, and the ingredients (powder materials) P and the mixing water L to be mixed in the mixer 10 are fed to the mixer 10 through the powder supply conduit 15 and the water supply conduit 16. The ingredients and water are introduced into the inner region of the mixer 10, stirred therein and mixed with each other, while moving radially outward on the disc 32 under the action of centrifugal force and moving circumferentially at the peripheral zone.

A part of the slurry produced in the area 10*a* flows into the conduits 8*a*, 8*b* through the fractionation ports 48*a*, 48*b*, and the slurry is discharged through the conduits 8*a*, 8*b* onto the edge zones of the lower sheet 1 (FIG. 1). In this embodiment, each of the ports 48*a*, 48*b* is not provided with a foam feeding port, and therefore, the slurry 3*b* (FIG. 2) fed to the edge zones through the ports 48*a*, 48*b*, which does not include the foam, has a relatively high specific gravity, in comparison with the slurry 3*a* (FIG. 2) fed to the core zone through the hollow connector part 47. If each of the ports 48*a*, 48*b* is provided with a foam feeding port (not shown), a small amount of foam is fed to the slurry at each of the ports 48*a*, 48*b*. Even in such a case, the slurry 3*b* fed to the edge zones through the ports 48*a*, 48*b* usually has a relatively high specific gravity, in comparison with the slurry 3*a* fed to the core zone through the hollow connector part 47.

Most of the slurry produced in the mixing area 10*a* is displaced outward and frontward in the rotational direction by the tooth configurations 37, and the slurry flows out through the slurry outlet port 42 of the slurry delivery section 4 to the outside of the mixing area, in an approximately tangential direction, as shown by arrows in a partially enlarged view of FIG. 5. The hollow connector part 47 is constructed from a vertical side wall 47*a* on the upstream side, a vertical side wall 47*b* on the downstream side, a horizontal top wall 47*c* and a horizontal bottom wall 47*d*. The wall 47*a* extends in the approximately tangential direction with respect to the annular wall 23. The port 42 and the connector part 47 open to the internal mixing area 10*a* of the mixer 10, so that they receive the slurry of the area 10*a* in the approximately tangential direction.

The slurry delivery section 4 further includes a vertical chute 40 having a cylindrical form. The upstream open end of the connector part 47 is connected to the edge portion of the port 42. The downstream open end of the part 47 is connected to an upper opening 45 formed at an upper part of a cylindrical wall of the chute 40.

The slurry flows into a slurry passage 46 of the connector part 47 from the port 42, and then, flows into the vertical chute 40 through the opening 45. The foam feeding port 60 is located on the wall 47*a* on the upstream side in the rotational direction, so that the foam M is fed to the slurry immediately after entering the passage 46 through the port 42, under the pressure which derives or results from the pressure of the foam production means (not shown). The foam feeding means has a pressurizing means for feeding the foaming agent to the foam feeding conduit 50 under the pressure. The pressurizing means is, e.g., a head of a pump for feeding a raw material of the foaming agent, difference in height between the foam feeding device and the port 60, or the like.

As shown by dotted lines in FIG. 5, instead of the conduit 50, the foam feeding conduit 50' may be connected to the annular wall 23, wherein the conduit 50' has a foam feeding port 60' opening on an inner circumferential wall surface 23*a* of the wall 23. In such an arrangement for feeding the foam, the foam is fed to the slurry immediately before the slurry flows through the port 42. The slurry in the peripheral zone, which is fed with the foam, promptly flows through the port 42 into the passage 46 in an approximately tangential direction, immediately after the foam mixes into the slurry, and then, the slurry flows into the chute 40 from the passage 46. If desired, the conduit 50 may be connected with a cylindrical wall 41 of the chute 40 so that the port 60 opens on an inner circumferential wall surface 41*a* of the chute 40.

As shown in FIG. 5, the vertical chute 40 is provided with an intratubular area D, a transverse cross-section of which is a perfect circle with a radius r, a center of the radius r residing on a vertically extending center axis C1. The connector part 47 is connected to the chute 40 in a condition eccentrically on one side (at the position eccentric on the side downstream in the rotational direction of the mixer 10, in this embodiment). Therefore, the passage 46 opens to the area D in a position eccentric on one side. In a lower portion of the area D, the chute 40 is provided with an orifice member (not shown) having an orifice passage. The orifice passage acts to generate a swirling flow of the slurry and foam in the area D. The orifice member is described in detail, in PCT/JP2013/081872 which the same applicant of the present application filed. Therefore, further explanation thereon is omitted by reference of the PCT pamphlet WO2014/087892 of PCT/JP2013/081872.

The slurry and the foam entering the intratubular area D turn around the center axis C1 of the chute 40, so that the slurry swirls along an inside circumferential wall surface of the area D. Owing to the swirling motion or turning motion of the slurry in the area D, the slurry and the foam are subjected to a shearing force, whereby they are mixed with each other, so that the foam is uniformly dispersed in the slurry. The slurry gravitationally flows down in the area D so as to be discharged to the widthwise center area of the lower sheet 1 through the discharge pipe 7 (FIG. 1). Thus, the connector part 47 and the chute 40 constitutes the slurry delivery section 4 for feeding the slurry of the mixing area 10*a* onto the sheet of paper for gypsum board liner.

FIG. 8 is a perspective view showing the structure of the slurry delivery section 4.

The slurry outlet port 42 is provided with a plurality of horizontal or vertical (horizontal in this embodiment) blades or vanes 43. The blade 43 acts as mixing means which imposes a sharing force on the slurry passing through the port 42, thereby promoting kneading or mixing action. Each of the blades 43 is set to be approximately 1 mm to 5 mm in thickness. The blades 43 are arranged at equal intervals and form a plurality of slits 44 in the port 42. A dimension of a fluid passage of the slit 44 between the blades is set to be approximately in a range from 4 mm to 15 mm.

FIG. 9(A) is an elevational view showing a configuration of the foam feeding port 60 as seen from the slurry passage 46 of the connector part 47. FIGS. 9(B) and 10(A) are cross-sectional views taken along a line IX(B)-IX(B) and a line X(A)-X(A) of FIG. 9(A). FIG. 10(B) is a transverse cross-sectional view schematically showing positional relationship among the foam feeding conduit 50, the foam feeding port 60 and the vertical side wall 47*a*.

An intratubular fluid passage 51 of the conduit 50 has a cross-section in a form of a perfect circle with a diameter di. The foam M produced by the foam production device (not shown) is continuously fed to the port 60 by the conduit 50. A center axis C2 of the passage 51 is oriented in a direction of an angle θ with respect to an inside wall surface 47*f* of the vertical side wall 47*a*. The conduit 50 is integrally connected to the wall 47*a* and the port 60 opens on the wall surface 47*f*. An inner circumferential wall surface of the conduit 50 continues or joins with an opening edge 61 of the port 60. The edge 61 has an outline of a horizontally elongated elliptic shape, as shown in FIG. 9(A). A short diameter dh of the edge 61 is equal to the diameter di of the passage 51 and a long diameter dw of the edge 61 depends on the angle θ. The angle θ is set to be in a range of 90°±80°, preferably a range of 90°±70°, more preferably a range of 90°±60°. Thus, the opening face of the port 60 surrounded by the edge 61 defines an ejecting face flush with the wall surface 47*f*.

A ratio between a cross-sectional area A3 ($=\pi\times(di/2)^2$) of the passage 51 and an area A1 of the port 60 at the wall surface 47*f* (the area surrounded by the edge 61) is set to be in a range, preferably, between A3:A1=1:1.3 and A3:A1=1:3.0, more preferably, between A3:A1=1:1.4 and A3:A1=1:2.0.

The port 60 is provided with a plurality of partition members 62, each extending in a direction parallel with the wall surface of the top and bottom walls 47*c*, 47*d*. Each of the members 62 is a metal component which has a circular cross-section and which is partially ground on the side of the passage 46 so as to be flash with the wall surface 47*f*. For instance, a diameter dj of the metal component is set to be approximately 4 mm. The port 60 is divided into a plurality of slit-shaped fluid passages 63 by the partition members 62, each extending in a horizontal or transverse direction. In this embodiment, the two partition members 62 are provided in the port 60, and the port 60 is divided into the three slit-shaped fluid passages 63. Thus, the region of the port 60 including the aforementioned ejecting face, edge 61 and partition members 62, i.e., an ejecting region is divided into a plurality of openings (the slit-shaped fluid passages 63).

A ratio between the cross-sectional area A1 of the port 60 (the area surrounded by the edge 61) in a position of the wall surface 47*f* and the fluid passage area A2 of the port 60 (the total area of the slit-shaped fluid passages 63) is set to be in a range, preferably, between A1:A2=1:0.5 and A1:A2=1:0.95, more preferably, between A1:A2=1:0.6 and A1:A2=1:0.85. For example, when the ratio is set to be A1:A2=1:0.75, the ratio between the area A2 of the port 60 and the cross-sectional area A3 ($=\pi\times(di/2)^2$) of the passage 51 is in a range between A2:A3=0.975:1 and A2:A3=2.25:1. Preferably, A2/A3 is set to be equal to or greater than 1.0.

As shown in FIGS. 9(A), 9(B), 10(A) and 10(B), the foam M flows toward the port 60 in the passage 51. The foam M reaches the port 60 enlarged in a flowing direction of the flow of slurry S in the passage 46, and the flow of the foam M is divided into split flows m by the partition members 62, each passing through each of the passages 63 into the passage 46. In the experiments of the present inventors, the foam M can be homogeneously or uniformly mixed and dispersed in the flow of slurry S in the passage 46 by such enlargement of the port 60 and division of the supply flow of the foam M. Even when the flow rate of the foam M is increased, an irregular or discontinuous behavior, a pulsation phenomenon, and the like do not occur in the split flows m of the foam M passing through the port 60 into the passage 46. According to the consideration of the present inventors, this results from the fluid resistance acting on the foam M passing through the passage (the slit-shaped fluid passage 63) between the partition members 62, the hydrodynamic pressure difference across the partition member 62, the back pressure acting on the intratubular passage 51 in proximity to the partition members 62, change in the fluid pressure and the flow rate of the foam M occurring when the foam M passes over the partition member, averaging of the delivery pressure and the delivery flow rate in the ejecting face due to dispersed delivery of the foam M, and so forth.

FIGS. 11(A) and 11(B) are a cross-sectional view and a side elevational view, which show a modification of the slurry delivery section 4.

The slurry delivery section 4' as shown in FIGS. 11(A) and 11(B) is arranged as an attachment for the slurry delivery section, which can be detachably mounted on the annular wall 23 of the mixer 10. The attachment has a structure integrally assembling the slurry outlet port 42, the hollow connector part 47, the vertical chute 40, the foam feeding conduit 50 and the foam feeding port 60. The port 42 is not provided with the blade 43, and it fully opens to the internal mixing area 10*a*.

As shown in FIG. 11(C), the conduit 50 and a part of the vertical side wall 47*a* surrounding the port 60 may be integrally assembled to be an attachment 65 for the foam feeding port, which can be detachably mounted on the attachment for the slurry delivery section. Alternatively, the attachment 65 may be detachably mounted on the hollow connector part 47 of the slurry delivery section 4 integrally assembled to the mixer 10 as shown in FIG. 5.

As means for mounting the attachment for the slurry delivery section on the casing 20 or means for mounting the attachment 65 on the attachment for the slurry delivery section, conventional mounting means may be employed, such as fitting, bonding, welding, or otherwise, fixing, fastening or latching with use of fastening or latching elements (such as nuts and bolts).

As shown in FIG. 11(A), the conduit 50 externally and horizontally protrudes from the wall 47*a*, in a direction of an angle θ. A foam supply path 52 shown by dotted lines is connected with an end of the conduit 50. The port 60 is divided into the slit-shaped fluid passages 63 by the partition members 62, and the foam M fed by the path 52 reaches the port 60 enlarged in the flowing direction of the slurry S in the passage 46. The foam M is divided by the partition member 62 so as to flow through each of the passages 63 into the passage 46.

FIGS. 12(A)-12(F) are cross-sectional or elevational views which show modifications of the port 60.

In the aforementioned embodiments, the port 60 is divided into the three slit-shaped fluid passages 63 by the partition members 62, each having a round cross-section. However, the port 60 may be divided by the partition members 62, each having an elliptical or oval cross-section, as shown in FIG. 12(A), or the port 60 may be divided by the member 62, each having a square or rectangular cross-section, as shown in FIG. 12(B). Further, the port 60 may be divided into the four or more passages 63 as shown in FIG. 12(A). Furthermore, the port 60 may be divided by the horizontal members 62 and the vertical partition members 64 as shown in FIG. 12(C). The port 60 may be divided by the vertical members 64 as shown in FIG. 12(D), or the partition members 65 extending in an oblique or inclined direction as shown in FIG. 12(E). In addition, it is possible to configure the port 60 to have an elliptical or oval profile elongated in the vertical direction.

FIGS. 13(A) and 13(B) are cross-sectional or elevational views showing the other modification of the port 60.

The port 60 as shown in FIGS. 13(A) and 13(B) has an opening edge 61' formed in a flared or divergent shape enlarged toward the passage 46 of the part 47. The inner circumferential surface of the edge 61' is inclined radially outward so as to enlarge the flow path area of the passage 51 at the port 60. For instance, when the angle θ is equal to 90°, the area A1 of the port 60 (the area of the ejecting face surrounded by an end 61" of the edge 61') is enlarged in accordance with an inclination angle θ' of the edge 61' with respect to a center axis C3 of the port 60. When the angle θ is not equal to 90°, the area A1 of the port 60 is enlarged in accordance with the angles θ', θ. The angle θ' of the edge 61' is not necessarily set to be a uniform angle throughout the entire circumference, but it can be set to vary in accordance with circumferential positions, or gradually increase or decrease along a circumferential direction.

FIG. 14 is a cross-sectional view generally showing a method for setting the inclination angle of the conduit 50, wherein the constituents of the slurry delivery section 4" are schematically illustrated.

In FIG. 14, there is shown a straight line RL which passes through a center Q1 of the port 60 and an upstream end Q2 of the side wall 47*b* located on the downstream side in the rotational direction. The end Q2 is a junction or intersection of the inner circumferential wall surface 23*a* of the annular wall 23 and the inside wall surface 47*g* of the side wall 47*b*, as seen from their upper side. As seen from the upper side, the center axis C2 of the intratubular fluid passage 51 is positioned in an angle range θ" between the line RL and the inside wall surface 47*f* of the side wall 47*a*. The angle range θ" is defined by the maximum value θmax of the angle θ of the center line C2. In a case of the slurry delivery section 4" as shown in FIG. 14, the angle θmax is approximately 120°. The minimum value θmin of the angle θ of the center line C2 is set to be approximately 10°.

Although the present invention has been described as to preferred embodiments and examples, the present invention is not limited thereto, but may be carried out in any of various modifications or variations without departing from the scope of the invention as defined in the accompanying claims.

For instance, the arrangement of the mixer according to the present invention can be equally applied to a mixer other than the pin type of mixer, such as a pinless mixer (a vane-type mixer or the like).

Further, in the mixer according to the aforementioned embodiments, the single foam feeding port having the partition members is positioned in the hollow connector part of the slurry delivery section, but the plural foam feeding ports may be provided in the hollow connector part, or the foam feeding port with the partition members may be provided in the annular wall of the casing of the mixer, the vertical chute, a tubular passage for transporting the slurry, a slurry delivery conduit or the like. For example, the foam feeding port with the partition members may be provided in the tubular passage for transporting the slurry, which is connected with a slurry outlet port of the annular wall of the mixer, as described in aforementioned U.S. Pat. No. 6,494,609 (Patent Literature 3).

In addition, the gypsum board manufacturing process in the aforementioned embodiment is so arranged that the slurry with a relatively high specific gravity fractionated by the fractionation port on the annular wall of the mixer is fed to the edge portions of the lower sheet, but at least a part of the slurry with the high specific gravity may be fed to a roll coater and so forth, so as to coat the lower and/or upper sheet with the slurry having the high specific gravity.

INDUSTRIAL APPLICABILITY

As set forth above, the present invention can be preferably applied to a mixer, a mixing method, and a method for producing light-weight gypsum boards. According to the present invention, the behavior of the delivery flow of the foam fed to the gypsum slurry can be stabilized, and a relatively large amount of foam can be homogeneously or uniformly dispersed in the slurry.

Further, production of light-weight gypsum boards with the specific gravity of 0.4-0.7 has been attracting attention in recent years. According to the present invention, the relatively large amount of foam can be mixed in the slurry relatively easily in the manufacturing process of such light-weight gypsum boards. Therefore, when the tendency of reduction in weight of the gypsum boards in recent years is taken into consideration, the advantages of the present invention are remarkable in practice.

LIST OF REFERENCE NUMERALS

1 lower sheet of paper
2 upper sheet of paper
3 slurry
4 slurry delivery section
5 belt-like layered formation
7 slurry discharge pipe
8 conduits for fractionation
10 mixer
10*a* internal mixing area
20 casing (housing)
23 annular wall
30 rotatable vertical shaft
32 rotary disc
40 cylindrical vertical chute
42 slurry outlet port
46 slurry passage
47 hollow connector part
47*a*, 47*b* vertical side wall
47*c*, 47*d* top and bottom walls
47*f* inside wall surface
50 foam feeding conduit
51 intratubular fluid passage
60 foam feeding port
61, 61' opening edge
62, 64, 65 partition member
63 slit-shaped fluid passage
M foam (supply flow)
m foam (split flow)
S flow of slurry
C2 center axis
θ, θ', θ" angle
di diameter
dh short diameter
dw long diameter
dj diameter

The invention claimed is:

1. A mixing method of gypsum slurry, in which the gypsum slurry is prepared in a mixing area of a mixer, the slurry is delivered out of the mixing area through a slurry delivery section of the mixer, foam is fed under pressure to the slurry in the mixing area and/or the slurry in the slurry delivery section, and a production line for forming gypsum boards or gypsum-based boards, is supplied with the slurry having the foam mixed therein, comprising steps of:

positioning a feeding port of the foam for feeding the foam to said slurry, in the mixing area and/or the slurry delivery section, dividing an ejecting region of said port ejecting the foam to a flowing fluid of said slurry, by a partition member, delivering the foam to said port through a fluid passage of the foam, and ejecting said foam to said fluid of the slurry simultaneously through a plurality of openings defined by division of the ejecting region.

2. The method as defined in claim 1, wherein an amount of the foam to be fed to said slurry is so set as to form a gypsum core of said gypsum board having a specific gravity in a range from 0.4 to 0.7.

3. The method as defined in claim 1, wherein said fluid passage has a center axis of the fluid passage or a center line of its flow path inclined at a predetermined angle with respect to an ejecting face of said port, so that the ejecting face horizontally or transversely enlarges in accordance with an angle of inclination of the fluid passage.

4. The method as defined in claim 1, wherein said ejecting region is provided with the plurality of partition members extending along a flowing direction of the slurry, and a plurality of slit-shaped fluid passages are formed as said openings in the ejecting region.

5. The method as defined in claim 1, wherein a ratio between a cross-sectional area A1 of said ejecting face surrounded by a peripheral edge of an ejecting face of said port and a total value A2 of areas of said openings is set to be in a range between A1:A2=1:0.6 and A1:A2=1:0.85.

6. A method for producing light-weight gypsum boards having a specific gravity equal to or less than 0.8, in which gypsum slurry is prepared in a mixing area of a mixer, the slurry is delivered out of the mixing area through a slurry delivery section of the mixer, foam is fed under pressure to the slurry in the mixing area and/or the slurry in the slurry delivery section, and a production line for forming gypsum boards is supplied with the slurry having the foam mixed therein, comprising steps of:

positioning a feeding port of the foam for feeding the foam to said slurry, in the mixing area and/or the slurry delivery section, dividing an ejecting region of said port ejecting the foam to a flowing fluid of said slurry, by a partition member, delivering the foam to said port through a fluid passage of the foam, and ejecting said foam to said fluid of the slurry simultaneously through a plurality of openings defined by division of the ejecting region, wherein an amount of the foam to be ejected to said slurry is so set as to form a gypsum core of said gypsum board having a specific gravity equal to or less than 0.7.

7. The method as defined in claim 6, wherein said port is arranged to open on an inner wall surface of a hollow connector part connecting a casing of the mixer and a vertical chute allowing the prepared slurry to gravitationally flow down, and wherein a plurality of slit-shaped fluid passages, which extend along a flowing direction of the slurry flowing in the connector part, are formed as said openings by means of the partition member.

8. The method as defined in claim 6, wherein said port is arranged to open on an annular wall of a casing of said mixer so as to feed the foam to the slurry immediately before the slurry flows out of the mixing area through a slurry outlet port, and wherein a plurality of slit-shaped fluid passages, which extend along a flowing direction of the slurry flowing in a peripheral zone of the mixing area, are formed as said openings by means of the partition member.

9. The method as defined in claim 6, wherein the foam is fed to said fluid passage under pressure, so that a fluid of the foam is ejected through said feeding port and mixed into the slurry under the feeding pressure of the foam.

* * * * *